US005137210A

United States Patent [19]

Hibbs

[11] Patent Number: 5,137,210

[45] Date of Patent: Aug. 11, 1992

[54] BEVERAGE CUP WITH ATTACHED SIDE POUCH FOR FOOD

[76] Inventor: Brenda K. Hibbs, 232 Seneca Ave., Byesville, Ohio 43723

[21] Appl. No.: 507,749

[22] Filed: Apr. 12, 1990

[51] Int. Cl.[5] ..... B65D 3/24

[52] U.S. Cl. ..... 229/120.18; 229/1.5 B; 229/1.5 H

[58] Field of Search ..... 229/1.5 H, 1.5 B, 120, 229/18; 206/217, 218; 220/85 H

[56] References Cited

U.S. PATENT DOCUMENTS 2,794,545 6/1957 Olson ..... 229/1.5 B
2,967,609 1/1961 Gabbard ..... 229/1.5 B
3,051,365 8/1962 Sayford, Jr. ..... 229/1.5 H
3,926,361 12/1975 Hilderbrand ..... 229/1.5 B

*Primary Examiner*—Gary E. Elkins

[57] ABSTRACT

A novel beverage cup with a side pouch for holding a food product. The side pouch is designed so that it is collapsible against the exerior side of the beverage cup. Thereby the cup is nestable one in another for convenient shipping and storage. The beverage and side pouch is formed from a single paperboard blank. Preferably, a plastic straw or paper straw is used in conjunction with the beverage cup. The container allows a patron to conveniently carry a food product and a beverage while freeing one of the patron's hands.

3 Claims, 1 Drawing Sheet

BEVERAGE CUP WITH ATTACHED SIDE POUCH FOR FOOD

BACKGROUND OF THE INVENTION

1. Field of the Invention

The present invention relates generally to a paperboard, or like foldable material, combination container, used for the dispensing of a beverage and food product. More specifically, the invention relates to a combination container which incorporates a novel beverage cup with an attached side pouch to hold an edible product generally dispensed at fast food restaurants, amusement parks, fairs and the like.

2. Description of Prior Art

It is often desirable to holds a beverage cup and food container in one hand in order to leave the other hand free to enable eating and drinking. For example, a patron at an amusement park or fair where the patron is generally standing or walking while trying to eat and drink his/her refreshments. Due to the lack of a free hand, the patron will generally drink the beverage first to dispose of the beverage container thereby freeing one hand ot enable the patron to eat the food. However, it is often more desirable to alternate eating the food and drinking the beverage.

Another example of the problem pertains to a patron holding a beverage cup and food container in the theater, stadium, or an automobile. The patron is seated, but facilities for resting the food and drink ususally are not provided.

Compound with the inconvenience of holding both the beverage and food, a patron often spills the beverage, food or both while attempting to manipulate holding both containers and eating or drinking the contents.

Some examples of the prior art beverage and food containers are set forth in the patents briefly described below.

The Minton U.S. PAt. No. 2,920,804, shows a glass holding and serving tray. Although the tray holds both a food and beverage, one hand must hold the tray while the other hand removes the beverage glass from the tray. This manipulating act makes the Minton Patent awkward to use and very susceptible to spillage.

Both the Martin U.S. Pat. No. 2,003,895, and the Freud U.S. Pat. No. 2,307,882, show holders that support a food receptacle, such as a plate, and beverage container that can be carried by one hand. However, in each, the Martin and Freud Patent, when the beverage is removed from the holder, the food receptacle becomes unbalanced which could cause spillage.

The Pauldides U.S. PAt. No. Des. 258,796, shows a partitioned cup for holding two beverages or a beverage and a food product. If the Paulides Patent is being used to hold two beverages, the beverage of the side not being drank from would spill while an individual tried to drink from the opposite side. Additionally, if an individual placed a food product in one side, it too would spill as the beverage is being tipped for consumption.

The Mansueto U.S. Pat. No. 295,010, shows a cup with an attached side pouch to receive a tea bag or the like. Although the device is not intended to hold a food product, it is being cited because of the relative similarity of design to the present invention. However, the Mansueto Patent design by nature is not nestable, thereby making it costly for shipping and storage.

The Daviss U.S. Pat. No. 4,491,220, shows a container for holding popcorn with a mounted band used for holding a drink cup. The Daviss Patent is very limiting in use as the design is not functional for food items other than popcorn.

The Huffman U.S. Pat. No. 3,640,380, shows a portable food and drink carrier. The Huffman Patent allows an individual to carry a beverage and food product with one hand. However, the device is bulky and cumbersome to use, necessitating the use of a table for resting the carrier in order to free the hands.

The Petrone U.S. Pat. No. 3,094,264, also shows a portable food and drink carrier which allows an individual to carry a beverage and food product with one hand. Although the Petrone Patent provides the freedom of one hand, the construction of the device is cost prohibiting and time consuming to assemble.

The English U.S. Pat. No. 4,183,444, shows a plastic lid for a drink cup with an integral hanger designed for hanging a small container of food. The English Patent would necessitate the conformation of the other food container by requiring other container manufacturers to redesign their contaniner with a slot or hole.

The Brumby Et Al U.S. Pat. No. 2,856,113, shows a disposable ash receiving receptacle such as a band that is placed around a beverage cup. The receptacle would need to be enlarged to accomodate a food product. However, the process of assembling the band, placing it over the beverage cup, filling the beverage cup and then filling the food receptacle makes the Brumby Patent too time consuming and cumbersome for a vendor.

The Greist U.S. Pat. No. 1,762,331, shows a receptacle that is supported on a beverage glass as designed for lemon juice or the like. The receptacle would need to be enlarged to accomodate a food product. However, the present design of the rreceptacle does not provide sufficient support for a heavier food item. Placement of the receptacle of the Greist Patent could cause spillage especially if the receptacle containing the food becomes heavier than the beverage glass.

The Woollen Et Al U.S. Pat. No. 3,288,344, and the Gereke U.S. Pat. No. 3,323,706, both show a combination beverage and food product container. The containers have an upper partition for holding food with a lower partition for holding a beverage. The upper partitions have an opening or identation to allow a straw to reach the beverage in the lower partition. In both, The Woollen Patent and the Gereke Patent, the combination containers however are not economical for a vendor to use due to the design requiring essentially two containers to create one container.

The McFarlin U.S. Pat. No. 3,567,105, shows a combination beverage and food product container. The container, rectangular in shape, is partitioned into two compartments; the larger compartment holds a food product such as popcorn, the smaller compartment holds a beverage. However, the McFarlin Patent is cumbersome to use due to the narrow parallel walls causing the food product nearest to the bottom of the compartment to be difficult to reach. If the patron should slant the container to retrieve the food product, this position could cause spillage of the beverage.

The Bartelt U.S. Pat. No. 4,620,631, shows a device for holding thwo containers such as beverage cup and food container. The larger container, for holding food, has a strip of flexible material bonded to the side wall to form a loop to receive a second container, for a beverage. The placement of the loop does not allow the bottom of the smaller container to rest on a flat surface such as a table or the like. Thereby, the Bartelt Patent is very susceptible to spillage.

Whatever the precise merits, features and advantages of the above cited references, none of them achieves or fulfills the purposes of a combination beverage and food product container as accomplished by the present invention.

SUMMARY OF THE INVENTION

Accordingly, it is a principal object of the present invention to provide a combination beverage and food product container so designed that the combination container can be held with one hand to enable an individual to eat the food more conveniently without the probaility of spillage.

It is another object of the present invention to improve the packagging assocaited with dispensing a beverage and a food product, thereby designing a combination container that is cost effective and convenient to use.

Still another object of this invention is to provide a combination container that is constructed with nestable characteristics for economical shipping and storage.

These objects, as well as other objects which will become apparent from the discussion that follows, are achieved, according to the present invention, through the construction of the combination container. The device comprises a novel beverage cup with a side pouch for holding food. The side pouch of the beverage cup is designed so that it is collapsible to be conveniently stored and stacked in a nestable configuration and later flexed open to hold a food product. The combination container is formed of a paperboard blank and folded to form the side pouch which is secured together within the beverage cup seam. Preferably, a plastic or paper straw is used in conjunction with the combination container whereby a person can easily drink the beverage without possible spillage of the beverage of the food product.

The foregoing and other objects, features and advantages of the invention will be apparent from the following more particular description of the preferred embodiments of the invention, as illustrated in the accompanying drawing.

DETAILED DESCRIPTION OF THE DRAWINGS

Figure 1:
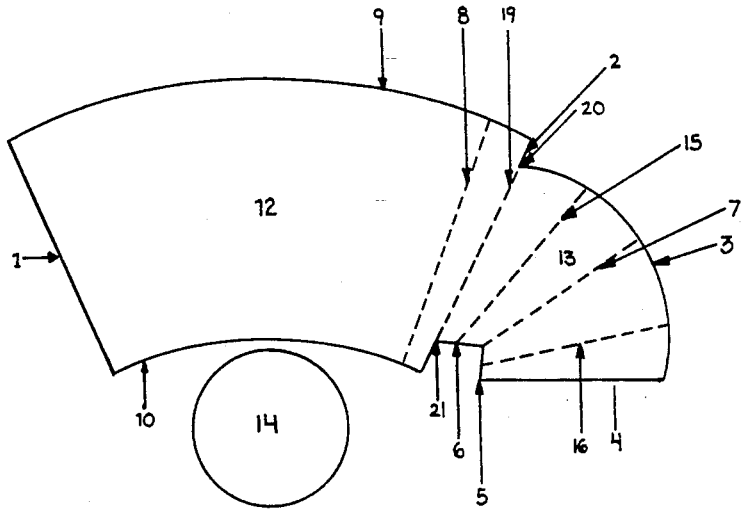
FIG. 1 is a plan view of the blank for forming the combination container according to the invention.

Referring now to FIGS. 1 through 4, illustrates a novel beverage cup with a side pouch designated as numeral 25. According to the present invention, such combination container 25 is comprised of a tubular sidewall element 12, a side pouch element 13, and a bottom closure element 14, formed of paperboard or other foldeable sheetlike material.

Refer to FIG. 1 which illustrates the preferred embodiment blank used to form the present invention. The blank forming the sidewall element 12, is generally crescent shaped with two opposing straight edges 1 nd 2, a convex top edge 9 and a convex bottom edge 10. The side pouch element 13 is formed integrally with sidewall element 12, edge 2, and being defined as deforming sidewall edge 2 and extending from a first point 20 adjacent the sidewall edge 2 and spaced between the sidewall top edge 9, and the sidewall bottom edge 10, preferably nearer the sidewall top edge 9, protruding from the sidewall edge 2, forming a generally sector-shaped blank, comprised of an arcuate edge 3, a straight radial edge 4 and a notch at the meeting points of the side pouch radial edge 4 and sidewall edge 2. The notch is formed by having two straight edges disposed at a generally right angle with side pouch notch edge 5 being respectively parallel to sidewall edge 2 and side pouch notch edge 6 respectively intersecting side pouch notch edge 5 and sidewall edge 2. Side pouch notch edge 6 is joined to a second point 21 which is adjacent sidewall edge 2 and between the first point 20 and above the sidewall bottom edge 10. FIG. 1 also illustrates the preferred embodiment, a circular blank used to form the bottom closure element 14.

It is believed that the combination container 25 could be assembled by affixing an adhesive on the side pouch notch edges 5 and 6, and folding the side pouch element 13 at the scored fold line 7 until the side pouch radial edge 4 is in a face to face relationship with the imaginary line 8 and overlapping sidewall edge 2. Sidewall edge 1 is wound to overlap radial edge 4. A seam is formed where sidewall edge 1 is secured with the adhesive to the area between the imaginary line 8 and sidewall edge 2. The bottom closure element 14 is affixed to the siedwall element 12 at the sidewall bottom edge 10, as is well understood in the art. As is also well understood in the art, the sidewall top edge 9 may be rolled back upon itself to form a bead or rim for reinforcement of the upper open edge of the beverage cup.

Figure 2:
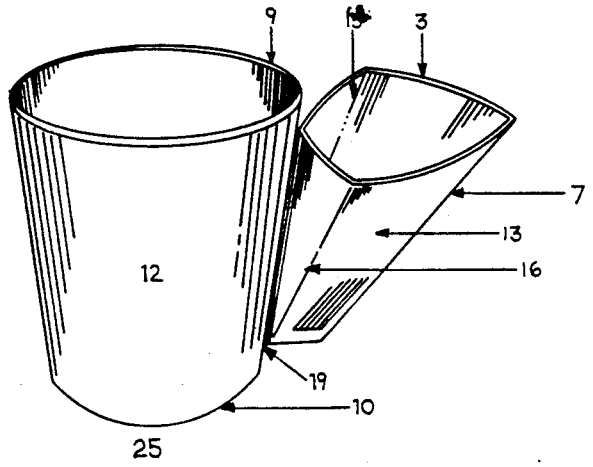
FIG. 2 is a perspective view of the combination container assembled and erected from the bland of FIG. 1, showing the manner in which the side pouch is flexed open and ready for use.

Refer to FIG. 2, which is an overall drawing of a preferred embodiment of the combination container 25, in the flexed open position and ready for placement of a food product in side pouch element 13. To assume the flexed open position it is believed that the present invention operates as follows, the side pouch arcuate edge 3 is pulled outward and pivoted radially from the exterior sidewall element 12 at the scored line 19 of FIG. 1. The side pouch element 13 is flexed at the scored fold lines 15 and 16 of FIG. 1 at which time an enlarged bell-mouth opening is provided to receive a food product. Also, the planes of the scored fold lines 15 and 16 diverge as they extend away from the side pouch notch edges 5 and 6 of FIG. 1. In such position, the flexed open side pouch element 13 rests on the secured side pouch notch edges 5 and 6 which in turn forms an appendage that assists in the balancing of the combination container 25, should it be placed on a flat surface. While in the flexed open position, it is further believed for the preferred use of the combination container 25 that a paper or plastic straw should be placed in the sidewall element 12 to avoid spillage of the food product from the side pouch element 13 while drinking the beverage.

Figure 3:
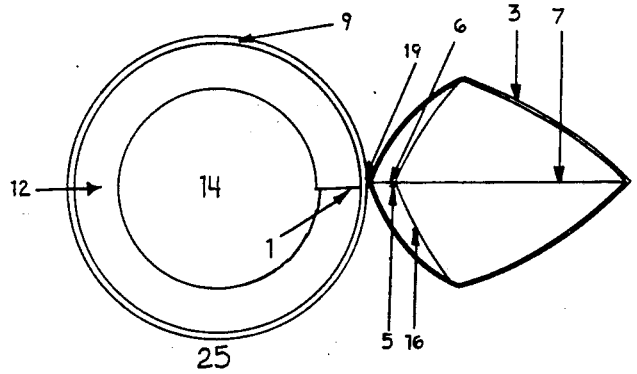
FIG. 3 is a top view of FIG. 2.

Refer to FIG. 3, which more clearly illustrates the side pouch element 13, being respectively hingedly connected to the exterior sidewall element 12 while in the flexed open position. FIG. 3, also illustrates the planes of the side pouch element 13, referring to the scored fold lines 15, 16 and 7.

Figure 4:
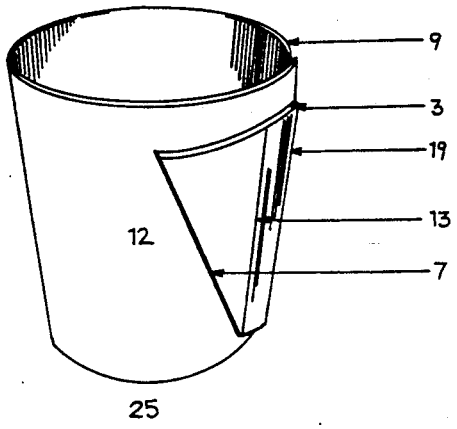
FIG. 4 is a perspective view showing the nestable position ready for shipping or storage in which the side pouch is folded in the flattened, collapsible position against the exterior sidewall of the beverage container.

Refer to FIG. 4 which illustrates the side pouch element 13 in the flattened position. It is believed to assume the flattened position, the side pouch element 13 is pulled outwardly at the scored fold line 7, causing the side pouch element 13 to collapse. The side pouch element 13 is placed against the exterior sidewall element 12 by being radially pivoted on the scored line 19. While in the flattened position the present invention can be used singly for a beverage. The use of a straw is not necessary in this position. A plastic lid or the like may be used with the combination container while in the flattened position or the flexed open position.

The combination container may be made of a parafin paperboard or of paperboard provided with inner facings of liquid-type material, including various plastic material in film form, or coatings sprayed or flowed in place on the inner surfaces of the finished container.

The construction of the combination container is an improvement over currently used containers and packages because it allows an invividual to carry one container where previously the individual was to carry two containers or packages. The present invention is more economical to use due to the elimination of one package or container previously needed when dispensing a beverage or food product. The present invention does not require assembling as is frequently the case with currently used packages and containers.

The foregoing description of the preferred embodiment of the invention has been presented for the purpose*s of illustration and description. It will be apparent that modifications or alterations in accordance with the present invetion can be made by those skilled in the art without departing from the scope and spirit therefore, and it is not intended to be exhaustive or to limit the invention to the precise form disclosed, as the assembly involving the application of glue, folding of the combination container blank, and finishing processes may be rearranged in order to accomplish these steps without departing from the scope of the invention. Many modifications and variations are possible in light of the above teachings. Thus, it will be ovious to those skilled in the art that many changes may be made without departing from the scope of the invention and the invetion is not to be considered limited to what is shown in the drawings and described in the specification.

What is claimed is:

1. A combination container for holding a beverage and a food product, designed to be carried in one hand, comprising a tubular sidewall member formed from a crescent-shaped blank of paperboard or like foldable material, and having opposed one straight edge and one edge deformed by the extended side pouch member, with the said straight edge of the blank overlapping the said deformed edge and secured one to another in a face to face relationship, the upper open end of said sidewall member being rolled back upon itself to form a rim, and a bottom member secured to the bottom of the said sidewall member and adapted to close the bottom of said sidewall member, said sidewall member having the said side pouch member formed integrally with said deformed edge of the blank from which said side pouch being defined by deforming one edge of said sidewall member, extending from a first point adjacent said deformed edge and space below said rim of said sidewall member, forming an arcuate edge blank having one straight radial edge and a notch as defined by having two straight edges disposed at a generally right angle and one said notch straight edge connected at a second point which is adjacent said deformed edge of said sidewall member spaced between said first point and bottom of said sidewall member, said side pouch blank being secured at said notch straight edges, having the said straight radial edge of the blank folded in a face to face relationship with the said deformed edge of said sidewall member and being secured by the overlapping said straight edge of the said sidewall member of the blank, said side pouch member being hingedly attached to the exterior of said sidewall member, said side pouch member being collapsable wherein said arcuate edge is folded in a face to face relationship, said side pouch member is pivoted radially wherby said side pouch member is flattened against the exterior of said sidewall member, said side pouch member is capable of being erected having a generally enlarged bell-mouth opening.

2. A combination container according to claim 1 is nestable one in another in which said side pouch member is collapsable wherein said arcuate edge is folded in a face to face relationship, said side pouch member is pivoted radially whereby said side pouch member is flattened against the exterior of said sidewall member.

3. A combination container of claim 1 wherein said blank is formed of a single sheet of paperboard or like material.

* * * * *